US005125436A

United States Patent [19]

Grabuschnig et al.

[11] Patent Number: 5,125,436

[45] Date of Patent: Jun. 30, 1992

[54] APPARATUS FOR LOADING A GRID-WELDING MACHINE WITH ELONGATE ELEMENTS

[75] Inventors: Josef Grabuschnig; Klaus Ritter; Gerhard Ritter, all of Graz, Austria

[73] Assignee: EVG Entwicklungs- & Verwertungs Ges.m.b.H., Graz, Austria

[21] Appl. No.: 474,850

[22] PCT Filed: Jan. 19, 1990

[86] PCT No.: PCT/AT90/00010

§ 371 Date: Oct. 1, 1990

§ 102(e) Date: Oct. 1, 1990

[87] PCT Pub. No.: WO90/08606

PCT Pub. Date: Aug. 9, 1990

[30] Foreign Application Priority Data

Feb. 2, 1989 [AT] Austria ..... 214/89

[51] Int. Cl.[5] ..... B21F 23/00

[52] U.S. Cl. ..... 140/112; 226/110

[58] Field of Search ..... 140/112; 226/110, 198, 226/199

[56] References Cited

U.S. PATENT DOCUMENTS 3,830,359 8/1974 Fogelberg .

FOREIGN PATENT DOCUMENTS 228028 6/1963 Austria .
280019 3/1970 Austria .
348314 2/1979 Austria .
373798 2/1984 Austria .
1287547 1/1969 Fed. Rep. of Germany .

*Primary Examiner*—Lowell A. Larson
*Attorney, Agent, or Firm*—Karl Hormann

[57] ABSTRACT

Apparatus for loading a grid-welding machine with elongate elements, comprising, evenly spaced from each other and arranged transverse to the feed direction in a feed plane, means (1) for inserting the elongate elements into feed channels (K) mounted in the feed plane for pivotal movement transverse to the feed direction, each feed channel being laterally confined by guide members (5) fixedly connected to the insertion member and individually pivotable transverse to the feed direction, the free ends of the guide members being releasably fixable to the inlet end of downstream feed members (7) of the welding machine by guide means (15, 16) mounted on the feed members, the feed members transversely moveable relative to the feed direction being adjustable to freely selectable transverse spacings and each feed member being connectable to one or more feed channels by the guide members.

11 Claims, 2 Drawing Sheets

APPARATUS FOR LOADING A GRID-WELDING MACHINE WITH ELONGATE ELEMENTS

Figure 1:
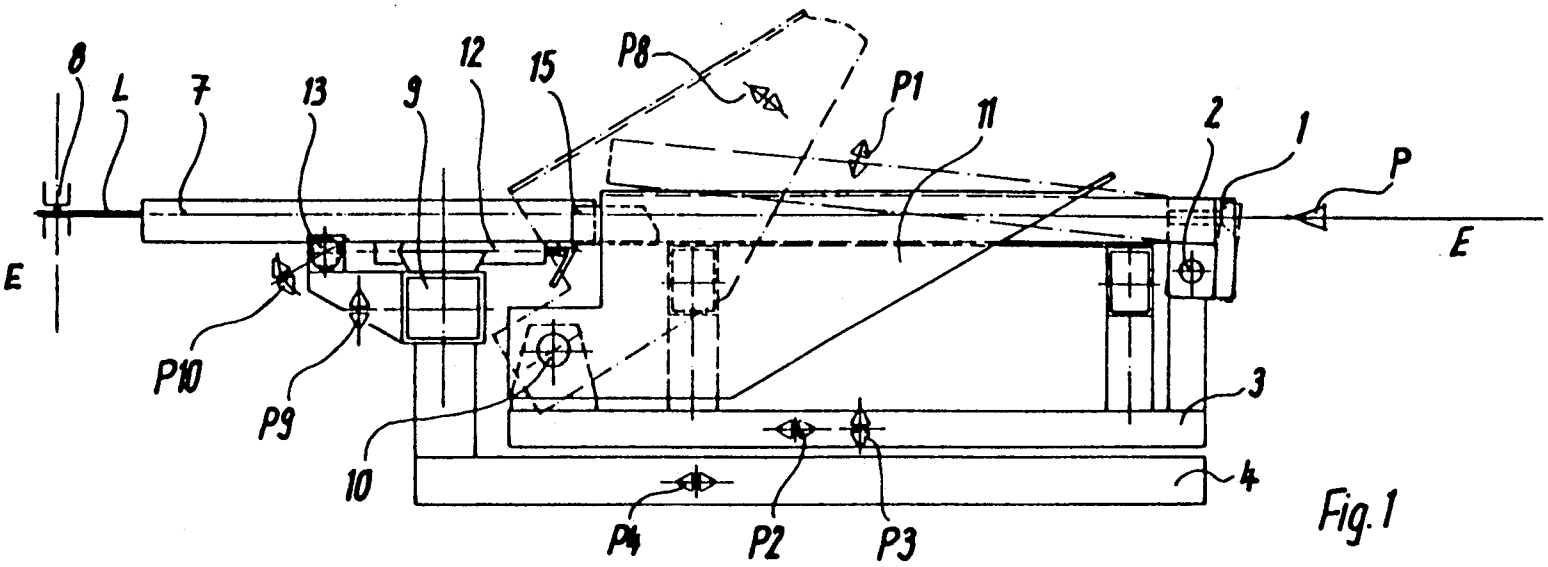

The invention relates to an apparatus for loading a grid-welding machine with elongate elements, comprising, evenly spaced from each other and arranged transverse to the feed direction in a feed plane, means for inserting the elongate elements into feed channels mounted in the feed plane for pivotal movement transverse to the feed direction.

An apparatus for feeding a plurality of flat iron strips arranged in parallel relationship and standing on edge, into a grid-welding machine is known from Austrian Patent 348,314. To permit freely to choose the spacing between the strips, a set of distributor tubes is interposed between a set of guide tubes spaced at fixed distances from each other and the welding machine, the distributor tubes having their input ends arranged at fixed spacings equal to the spacings between the guide tubes and being pivotally mounted so that the spacing between their output ends is selectable, the distributor tubes being fixable in their selected position. In the known apparatus the distributor tubes define feed channels of predetermined unchangeable widths, and they are pivotable as an integral unit only. Because of this arrangement, the pivoting range of each distributor tube is limited by the pivoting range of its adjacent distributor tube. Furthermore, the constant width of the distributor tubes limits the closest spacing between the elongate elements.

The invention aims at providing a loading apparatus in which the number of elongate elements as well as the spacing between them are freely selectable by means of variable feed channels. The apparatus in accordance with the invention is characterized in that each feed channel is confined in a transverse direction by guide elements which are rigidly connected to the insertion member and individually pivotable transversely of the feed direction and the free ends of which may be releasably connected to the input side of downstream feed members of the welding machine, by guide means affixed to these feed members, the feed members which are movable transversely of the feed direction being adjustable to freely selectable transverse spacings and each feed member being connectable to one or more of the feed channels.

It should be mentioned that to move feed members transversely of the feed direction is known from Austrian Patent 228.028 in connection with a different kind of apparatus.

In accordance with a preferred embodiment of the invention funnel-shaped insertion members and their guide members are mounted on an axis for pivotal movement in a direction vertically of the feed plane of the elongate members.

Preferably, the guide members are made of wear-resistant strips of spring-steel. In accordance with a further embodiment of the invention the guide means are constituted by closure covers pivotable in a direction vertically of the feed plane of the elongate members.

An improved embodiment of the invention is characterized in that the feed members are supportable by a spacer turret rotatable about an axis extending transversely of the feed direction and fixable in guide grooves provided in the periphery of the turret, one of the guide grooves being such that it allows for arbitrarily selectable spacings between the feed members, whereas the remaining guide grooves are arranged along the longitudinal axis of the turret in accordance with predetermined standard spacings of the feed members.

The apparatus in accordance with the invention makes it possible to vary the position of the side walls of the feed channels relative to each other, as well as the width of the feed channels, depending upon movement and position of the guide members. In particular, the movability ranges of all feed channel side walls may be increased in conjunction with adjacent feed channel side walls, that is to say by changing the width of the respective adjacent feed channel, and may optimally be adjusted to suit different diameters and spacings of elongate elements. In accordance with the invention elongate elements may, therefore, be transferred from feed positions of fixed unchangeable transverse spacings to feed members of freely adjustable transverse spacings as used, for instance, in welding machines for the manufacture of grid mats of arbitrarily selectable longitudinal rod spacings. The elongate members may be of any cross sectional shape, i.e. they may be round rods for the manufacture of grid mats, or they may be flat strips for the manufacture of gratings. The apparatus according to the invention also makes possible the conveying of single and double elongate elements to the feed elements of the welding machine.

Further characteristics of the invention will be explained in greater detail hereinafter with reference to the drawings, in connection with embodiments.

Figure 2:
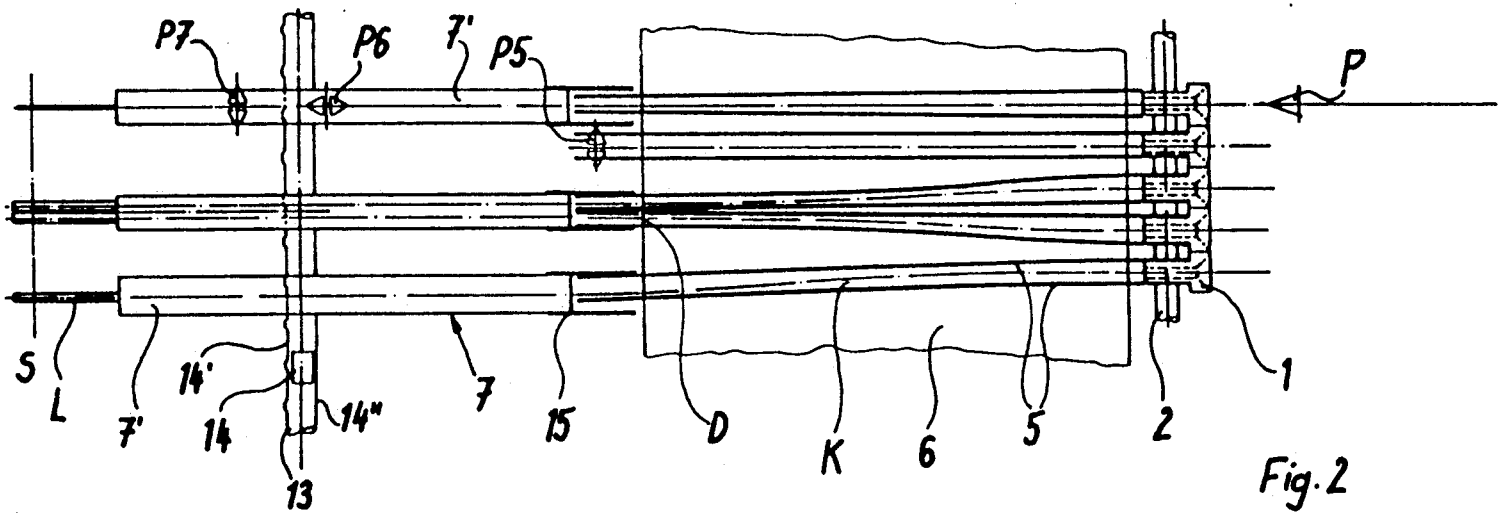
Figure 3:
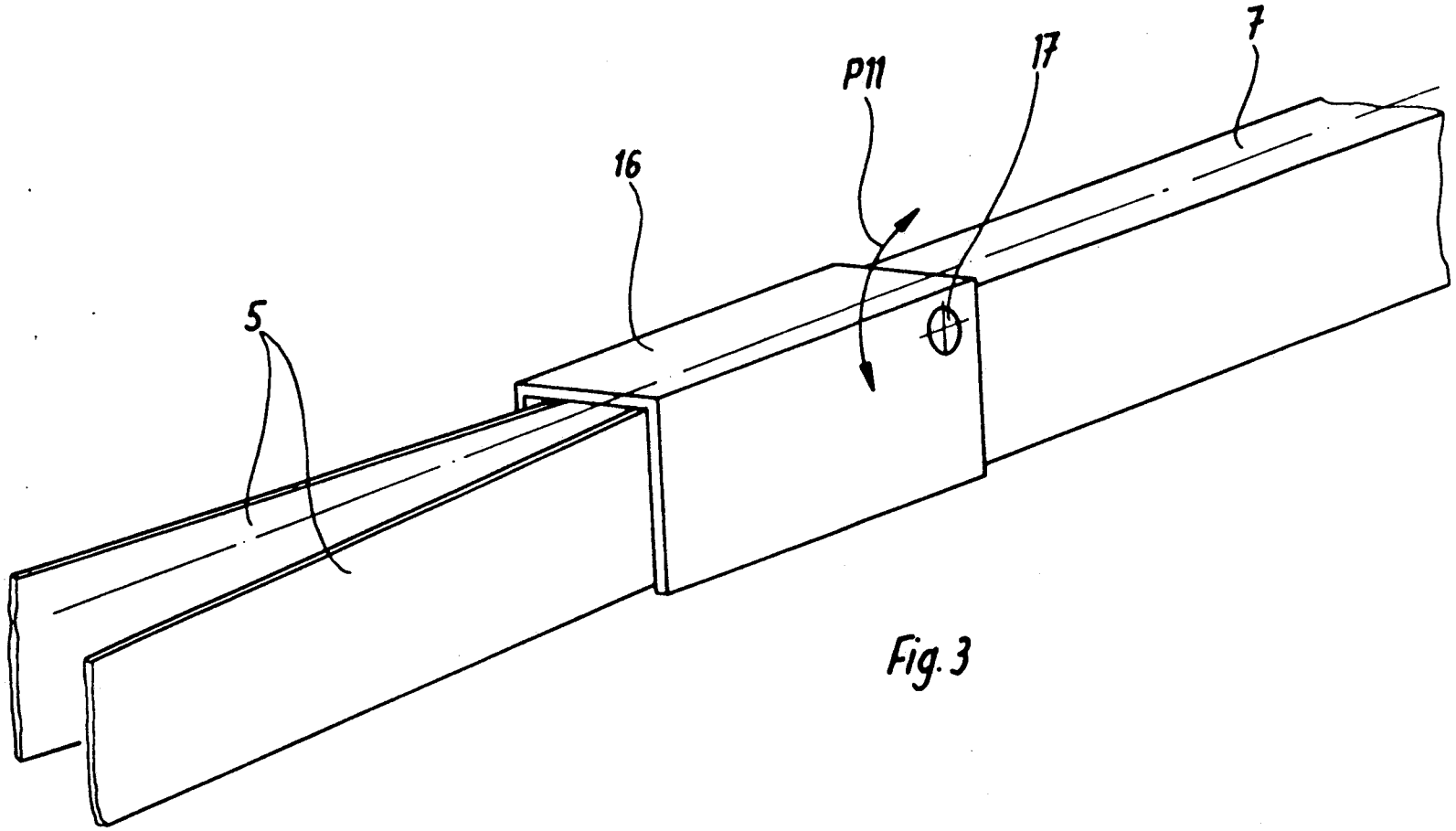

FIG. 1 is a schematic side elevation of an apparatus in accordance with the invention, FIG. 2 is a schematic planar view of FIG. 1, and FIG. 3 is a perspective view of a portion of the apparatus.

Hydraulically, pneumatically, electrically or manually actuable drive and adjustment means known per se, have been omitted from the drawings for the sake of clarity.

As shown in FIGS. 1 and 2, elongate elements L, for instance elongate rods, are conveyed in the direction of an arrow P to insertion funnels 1 by means of a feed carriage not shown, in a number required for the manufacture of a grid mat or the like, and at transverse spacings corresponding to the structure of the grid mat. The feed paths of the elongate elements L are in alignment with the openings of the insertion funnels 1. One elongate element L only is fed to each insertion funnel.

The insertion funnels 1 are positioned side by side and in parallel to the welding line S of the welding machine, in the feed plane E—E defined by the feed paths of the group of elongate elements. The number of insertion funnels 1 appropriately corresponds to the greatest number of elongate elements L which the welding machine can process. The spacing between the insertion funnels 1 is uniform and preferably corresponds to the smallest possible basic spacing between the electrodes of the grid welding machine. The insertion funnels 1 are connected to a frame 3 for pivoting vertically relative to the feed plane about an axis 2 in the direction of an arrow $P_1$, the frame 3 being longitudinally adjustable in the direction of an arrow $P_2$ and vertically in the direction of an arrow $P_3$, on a base frame 4 which is longitudinally movable in the direction of an arrow $P_4$.

Two guide members 5 standing on edge and defining a feed channel K for one elongate member L each are attached to the sides of the end of each insertion funnel 1 facing the welding machine. The guide members 5 may be made, for instance, of wear-resistant strips of spring-steel which at their free ends may be pivotable in the feed plane E—E transversely of the feed direction, in the direction of an arrow $P_5$. The length of the guide members 5 is selected so that at an extreme transverse deflection even elongate members of the largest dimensions which the downstream welding machine can handle, may slide in the feed channels K without permanent deformation and without causing undue frictional losses. A closure panel 6 affixed to the frame 3 limits the feed channels K in a downward direction and thus prevents the elongate elements L from dropping out of the channels.

Each feed channel K leads into a tubular feed member 7 each of which is directed toward a welding electrode 8 of the welding machine and is affixed to a lifting beam 9 for longitudinal movement in the direction of an arrow $P_6$ and for transverse movement in the direction of an arrow $P_7$. Furthermore, the feed channel K is covered by a closure 11 pivotable about an axis 10 in the direction of an arrow $P_8$.

For practical purposes the number of feed tubes 7 corresponds to the largest number of elongate elements the welding machine can handle. Latching of a feed tube 7 to the beam 9 may be accomplished by a releasable clamp 12. The lifting beam 9 is mounted on the base frame 4 for heightwise adjustment in the direction of an arrow $P_9$ so that the position of the feed tube 7 may be adjusted to elongate elements of different diameters The feed tube 7 is also supported by a turret 13 which is rotatable in the direction of an arrow $P_{10}$ about an axis intersecting the feed direction. The turret 13 is provided in its periphery with a plurality of centering grooves 14, 14' which are arranged in rows extending in parallel to the longitudinal direction of the turret 13. In this manner a plurality of predetermined standard spacings between the feed tubes 7 and, hence, between the elongate elements L, may quickly and repeatably be set. In addition, there is provided a continuous guide groove 14" extending over the entire length of the turret 13 which allows a stepless transversal movement of the feed tubes 7 and, therefore, a stepless setting of the spacing between the elongate elements.

Guide rails 15 are affixed to both sides of the end of the feed tube 7 facing the guide members 5, the guide rails extending the feed tube 7 in the direction of the guide members 5 and enclosing the guide members 5. In the feed tube 7 there are provided a V-shaped longitudinal groove and appropriate spring elements for elements pressing the elongate elements L into the groove and thus ensure a precisely reproducible exactly defined position of the elongate members during their movement into the welding machine.

At the start of production and at each change of the spacing between the elongate elements which requires adjusting the position of the welding electrodes 8 along the welding line S, the following steps are taken:

The frame 3 is retracted from an operating position in the direction of arrow $P_2$, opposite the feed direction P of the elongate elements L, until the guide members 5 are released from the guide rails 15 of the feed tubes 7 and may spring back to their initial position parallel to the feed direction P. The base frame 4 is the also retracted in a direction opposite the feed direction P of the elongate elements so that the feed tubes move away from the welding electrodes 8 of the welding machine and the position of the welding electrodes 8 may be adjusted in accordance with the desired spacing between the elongate elements. Thereafter, the clamping member 12 is released, and, if necessary, the feed tubes 7 are retracted in the direction of arrow $P_6$, in a direction opposite the feed direction P. After the position of the welding electrodes 8 has been adjusted the base frame 4 is returned to its initial position in the direction of arrow $P_4$.

The feed tubes 7 are lifted out of the guide grooves 14, 14' of the spacing turret 13, and the latter, depending upon the spacing between the elongate elements in the grid to be produced, is rotated in the direction of arrow $P_{10}$ in such a manner that the appropriate row of guide grooves 14, 14' or the endless guide groove 14 is moved into the upper operating position.

The feed tubes 7 are thereafter aligned relative to the welding electrodes 8 by transverse movement in the direction of the double arrow $P_7$, followed by longitudinal movement in the direction of the arrow $P_6$, by means of centering devices not shown, and fixed by the clamping device 12. Feed tubes 7 not required may be moved to a so-called parking position laterally of the production plane.

The closure 11 is then moved into its open position shown in broken line by pivoting in the direction of the arrow $P_8$, and the frame 3 is returned to its initial position in the direction $P_2$. Appropriate signals are sent from the welding machine control to signal indicators, not shown, preferably provided on the insertion funnels 1, to indicate to an operator which of the insertion funnels 1 should be loaded with elongate elements L from the supply carriage, not shown, for the kind of grid-mat to be manufactured, and which of the feed channels K should be aligned with the appropriate feed tubes 7.

Such matching is accomplished by pivoting the corresponding insertion funnel 1 and its two guide members 5 upwardly in the direction of the arrow $P_1$ into the position shown in broken line and by thereafter inserting the free ends of the guide members 5, by transverse movement in the direction of the arrow $P_5$, between the guide rails 15 of the corresponding feed tube 7. For this purpose, as shown in position D in connection with a so-called double weld in which two elongate elements L without transverse spacing are welded as a unit to the transverse elements, such as transverse rods, two feed channels K are inserted together between the guide rails 15 of a feed tube 7.

In FIG. 2, the feed tubes supplied with only one elongate element L are designated by 7', there being also shown that elongate elements of different diameters may be loaded. Since in many instances, depending upon the type of grid-mat desired, not all of the insertion funnels 1 will be required, those insertion funnels 1 will neither be matched with feed tubes 7 nor will they be loaded with elongate elements L from the supply carriage. As a final step the top of feed channels K is closed by lowering the closure 11 in the direction of arrow $P_8$ to prevent elongate elements from escaping in an upward direction.

In those cases in which the feed tubes 7 are to be loaded directly from the supply carriage all the feed channels K may be idled by lowering the frame 3 in the direction of the arrow $P_3$ out of the feed plane E—E.

In the alternate embodiment of the apparatus shown in FIG. 3 the insertion funnels 1 and the guide members 5 cannot be pivoted vertically of the feed plane of the bundle of elongate elements. Instead of the guide rails 15 there is provided, at the inlet of each feed tube 7, a U-shaped closure 16 which is open in a downward direction and pivotable in the direction of the arrow $P_{11}$.

For changing the mating of the feed channels K with the feed tubes 7, following the steps described supra, instead of pivoting the guide members 5 upwardly and inserting them between the guide rails, the closure 16 is initially pivoted upwardly in the direction of the arrow $P_{11}$, the guide members 5 are moved transversely in the direction of the arrow $P_5$ in accordance with the mating desired and are then fixed in their position by returning the closure 16 in the direction of the arrow $P_{11}$. Thereafter, all the feed channels K are again closed in an upward direction by lowering the closure 11 in the direction of the arrow $P_8$.

It will be appreciated that the described embodiment may be altered in different ways without departing from the inventive concept; for instance, instead of strips of spring steel strips of elastic plastics may be utilized, and the feed members may be different from their depicted shape.

We claim:

1. An apparatus for loading a grid-welding machine with a plurality of elongate elements, comprising:

means for moving said elongate elements in a predetermined direction in a given plane;

a plurality of feed channel means mounted in said plane for pivotal movement transverse to said direction;

means for inserting individual elongate elements into individual feed channel means, said inserting means being evenly spaced from each other in said plane and transverse to said direction;

feed members provided with inlet end means and moveable transversely of said direction and adjustable to freely selectable transverse spacings;

guide members for laterally confining each feed channel means and for connecting each feed member to one or more of said feed channel means, said guide members being connected to said inserting means and individually pivotable transversely of said direction and having free ends adapted to be releasably connected to said inlet end means of said feed members; and guide means mounted on said feed members for releasably connecting said free ends of said guide members to said inlet end means of said feed members.

2. The apparatus of claim 1, wherein said inserting means are shaped as funnels and are mounted with their associated guide members on an axis for pivotal movement vertically of said plane.

3. The apparatus of claim 2, wherein said guide members comprise strips of wear-resistant spring steel.

4. The apparatus of claim 3, wherein said guide means comprise closure means mounted for vertical pivotal movement relative to said plane.

5. The apparatus of claim 3, wherein said feed members are of tubular structure.

6. The apparatus of claim 5, wherein means is provided for supporting said feed members for longitudinal and vertical movement relative to said plane.

7. The apparatus of claim 6, wherein means is provided for releasably connecting said feed members on said support means.

8. The apparatus of claim 1, further comprising means for selectively fixing the spacing between said feed members.

9. The apparatus of claim 8, wherein said fixing means comprises adjustment means of a predetermined width and rotatable about an axis substantially normal to said direction and provided in its periphery with a plurality of grooves extending substantially parallel to said direction.

10. The apparatus of claim 9, wherein at least one of said grooves extends substantially over the entire width of said adjustment means.

11. The apparatus of claim 1, wherein said channel means are confined in their vertical directions by closure means.

* * * * *